US005174113A

United States Patent [19]

Deville

[11] Patent Number: 5,174,113

[45] Date of Patent: Dec. 29, 1992

[54] EXHAUST OUTLET WITH VENTURI

[75] Inventor: Paul Deville, Ayze, France

[73] Assignee: Devil, société anonyme, Marignier, France

[21] Appl. No.: 625,437

[22] Filed: Dec. 11, 1990

[30] Foreign Application Priority Data

Dec. 20, 1989 [FR] France ..... 89 17206

[51] Int. Cl.[5] ..... F01N 3/02

[52] U.S. Cl. ..... 60/309; 60/324; 138/44; 181/262

[58] Field of Search ..... 60/309, 316, 317, 319, 60/324; 181/227, 262, 263; 138/44

[56] References Cited

U.S. PATENT DOCUMENTS

| | | | |
|---|---|---|---|
| 956,785 | 5/1910 | Thomas | 181/227 |
| 1,654,078 | 12/1927 | Hall . | |
| 1,794,276 | 2/1931 | Bowes | 181/262 |
| 2,629,455 | 2/1953 | Cushman | 181/262 |
| 2,717,049 | 9/1955 | Langford | 60/309 |
| 4,018,580 | 4/1977 | Bürkholz | 55/466 |
| 4,690,245 | 9/1987 | Gregorich . | |
| 5,014,512 | 5/1991 | Kakuta | 60/324 |

FOREIGN PATENT DOCUMENTS

| | | |
|---|---|---|
| 606040 | 2/1926 | France . |
| 646606 | 11/1928 | France . |
| 746282 | 5/1933 | France . |
| 837061 | 11/1938 | France . |
| 2467974 | 4/1981 | France . |
| 89/05394 | 6/1989 | PCT Int'l Appl. . |
| 765639 | 1/1957 | United Kingdom . |
| 986576 | 3/1965 | United Kingdom . |
| 2054779 | 2/1981 | United Kingdom . |

*Primary Examiner*—Douglas Hart
*Attorney, Agent, or Firm*—William H. Eilberg

[57] ABSTRACT

An exhaust outlet with venturi is disclosed, comprising an upstream portion (18) in the form of a venturi, defined by upstream walls (16) converging at an open angle and connected, in a narrowed portion (15) to downstream walls (17) diverging at a more reduced angle and a cylindrical downstream portion (3) connected continuously to the downstream walls (17) of the upstream portion (18). The presence of the upstream portion in the form of a venturi substantially reduces the backlash noise without substantially affecting the available power of the engine.

16 Claims, 2 Drawing Sheets

EXHAUST OUTLET WITH VENTURI

BACKGROUND OF THE INVENTION

1. Field of the Invention

The present invention relates to exhaust outlets forming the end zone of an internal combustion engine exhaust line.

Exhaust outlets are generally intended to be connected to the outlet of an exhaust gas conduction duct, for example the outlet of the silencer, and they comprise an inlet orifice with means for connection to the exhaust gas conduction duct and an outlet orifice open to the free air for discharge of the gases, and means for conducting the gases from the inlet orifice to the outlet orifice.

In their simplest form, exhaust outlets are formed by a simple cylindrical tube.

In a specific embodiment described in the document W)-A-8 905 394, the exhaust outlet comprises an internal tube surrounded by a cylindrical outer casing. The internal tube comprises an upstream portion which narrows and is connected to a downstream portion which widens, so as to form an annular space between the internal tube and the outer casing. The fumes produced in the crankcase are introduced into the annular space where they are burnt by the heat released by the exhaust gases through the internal tube. The narrowed then widened form of the internal tube, associated with the cylindrical form of the outer casing, result in increasing the heat exchanges between the exhaust gases and the fumes. The form shown in the drawings, not stated in the description, is such that the ratio between the cross section of the narrowed portion and cross section of the cylindrical downstream portion is about 0.25. The form is unfavorable for the efficiency of the engine, and disadvantageously modifies the sonority of the exhaust by a shift towards the high-pitched sounds.

Attempts have always been made to reduce the noise produced by the exhaust of an internal combustion engine, particularly by disposing one or more silencers in the exhaust line. The noise of an exhaust system may be easily measured, for different running conditions of the internal combustion engine and for continuous running as well as for transitory running conditions. Standardized tests have been defined for type approval of vehicle exhausts equipping internal combustion engines.

We must in particular distinguish the exhaust noise produced under continuous running conditions of the engine, the engine then being off-load, with stabilized running, from the backlash noise. The backlash noise corresponds to the very brief rise of the noise level of an exhaust when the accelerator is suddenly released. It is a noise peak in relatively low frequencies, of about 100 Hz, which follows the continuous noise produced by the exhaust when the engine is under continuous running conditions, and which precedes the subsequent reduction of the noise following reduction of the engine speed. Measurement of the backlash noise forms part of the standardized tests for type approval of exhausts.

At the same time, it has been discovered that reduction of exhaust noise fairly often results in a reduction of the power which the internal combustion engine to which the exhaust is connected can deliver. Thus, for the same engine speed, a first exhaust connected to the engine and producing a relatively low noise will generally lead to reduction of engine power with respect to an exhaust producing more noise.

SUMMARY OF THE INVENTION

The object of the invention is in particular to reduce the noise produced by an exhaust outlet and more particularly the backlash noise, without disturbing the operation of the engine and without substantially reducing the power which it may deliver.

A particular embodiment of the invention further makes it possible to very substantially reduce the deposits of solid or liquid particles in the vicinity of the outlet orifice of the exhaust. Thus, liquid particles brought by the exhaust gases are prevented from dripping through the outlet orifice, and solid particles from being deposited about the outlet orifice and impairing the aesthetic appearance of the exhaust outlet.

According to the invention, the above effects are obtained by maintaining the internal aeraulic qualities of the exhaust outlet, i.e. without disturbing the power developed by the internal combustion engine to which the exhaust outlet is connected.

Another advantage of the invention is to slightly modify the sonority of the exhaust outlet, by producing a slightly deeper sound through elimination of certain high frequency components.

To attain these objects as well as others, the exhaust outlet according to the invention comprises:

- an inlet orifice with means for connection to an exhaust gas conduction duct,
- an outlet orifice open to the free air for the discharge of the gases,
- an axial tubular duct conveying the gases from the inlet orifice to the outlet orifice.

The axial tubular duct comprises an upstream portion in the form of a venturi, defined by upstream convergent venturi walls with open angle connected, in a narrowed portion, to downstream divergent venturi walls with more reduced angle, the axial tubular duct further comprising a cylindrical downstream portion connected continuously to the downstream venturi walls.

The ratio between the cross section of the narrowed portion of the venturi .and the cross section of the cylindrical downstream portion of the axial tubular duct is between about 0.35 and 0.70. Good results have been obtained in particular for a ratio equal to about 0.50.

Such a venturi structure very substantially reduces the backlash noise. This effect of substantial reduction of the backlash noise is likely due to the fact that the narrowed zone forms an obstacle for the acoustic waves from the outlet orifice and propagating towards the inlet orifice, and also forms an obstacle for the acoustic waves from the exhaust duct and going towards the inlet orifice. Everything happens as if the volume of the gas column situated from the outlet orifice in the direction of the outlet silencer were reduced. This reduction of volume causes certain low resonance frequencies corresponding to the backlash noise to disappear.

The internal tube form described or shown in the document WO-A-8 905 394 is not adapted to be able to obtain such a reduction of the backlash effect without disturbing the operation of the engine.

In a particular embodiment, the cylindrical downstream portion of the axial tubular duct is connected to an intermediate expansion chamber itself connected to an outlet tube conveying the gases to the outlet orifice. The central zone of the wall of the intermediate expansion chamber comprises at least one dust and liquid discharge orifice in its lower part. The purpose of the expansion chamber is to capture the solid and liquid particles which are brought by the exhaust gases, these particles being advantageously discharged through the dust and liquid discharge orifice. Thus, the exhaust outlet keeps its cleanliness to a maximum in the vicinity of the outlet orifice.

In an advantageous embodiment, the collector tube comprises apertures spaced apart about the periphery of its wall and an air intake is provided for the intake of outside air through the apertures. The air sucked in through the apertures is re-circulated and dilutes the exhaust gases. Furthermore, this flow of fresh air improves the gas flow and produces a peripheral layer of fresh air, at the level of the outlet orifice, which protects the zone of the outlet orifice from the hot and polluted gases.

BRIEF DESCRIPTION OF THE DRAWINGS

Other objects, features and advantages of the present invention will be clear from the following description of particular embodiments, in connection with the accompanying figures in which.

DESCRIPTION OF THE PREFERRED EMBODIMENTS

Figure 1:
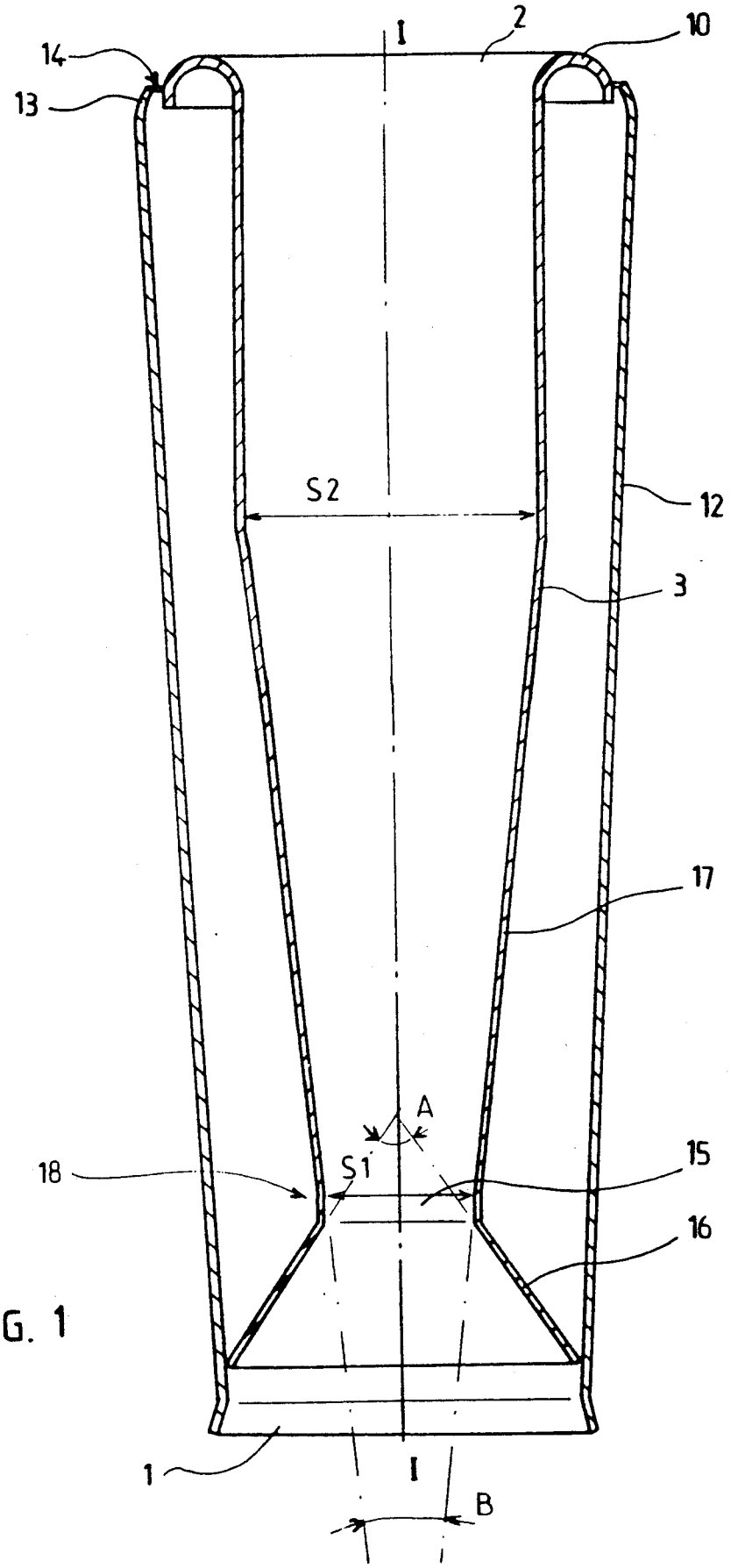
FIG. 1 is a longitudinal section of an exhaust outlet according to a first embodiment of the present invention.

As shown in the figures, the exhaust outlet according to the invention comprises an inlet orifice 1 adapted for connection to an exhaust gas conducting duct not shown in the figures, and an outlet orifice 2 open to the free air for the discharge of the gases. The exhaust outlet leads the gases from the inlet orifice 1 to the outlet orifice 2 through an axial tubular duct comprising an upstream portion 18 in the form of a venturi and a cylindrical downstream portion 3 connected to said upstream portion 18.

The upstream venturi portion 18 is defined by upstream walls 16 convergent at open angle A and connected, in a narrowed portion 15, to downstream walls 17 diverging at an angle B more reduced than angle A. The open angle A of the upstream walls 16 is advantageously between about 60° and 90°. Angle B of the downstream walls 17 is advantageously between about 7° and 30°. The venturi is characterized by the ratio between the minimum flow section S1, or cross section of the narrowed portion 15 and the maximum flow section S2, or cross section of the cylindrical downstream portion 3. The ratio between the cross section S1 of the narrowed portion and the cross section S2 of the cylindrical downstream portion is between about 0.35 and 0.70, advantageously equal to about 0.50.

In the embodiments shown, the upstream venturi walls 16 are connected to the inlet orifice 1 and the cross section of the inlet orifice is greater than the cross section S2 of the cylindrical downstream portion.

In the embodiment shown in FIG. 1, the cylindrical downstream portion 3 continues as far as the outlet orifice 2 and ends in a rounded flange 10 bent outwardly.

An outer casing 12 covers the whole of the lateral faces of the venturi upstream portion 18 and of the cylindrical downstream portion 3. In the zone of the inlet orifice 1, the outer casing 12 is connected to the upstream wall 16. On the other hand, in the zone of the outlet orifice 2, the periphery of flange 10, forming the outlet orifice 2, is non jointing with the end edge 13 of the outer casing 12, defining an annular passage 14. The outer casing may for example be cylindrical or conical, opening out in the direction of the outlet orifice 2.

Figure 2:
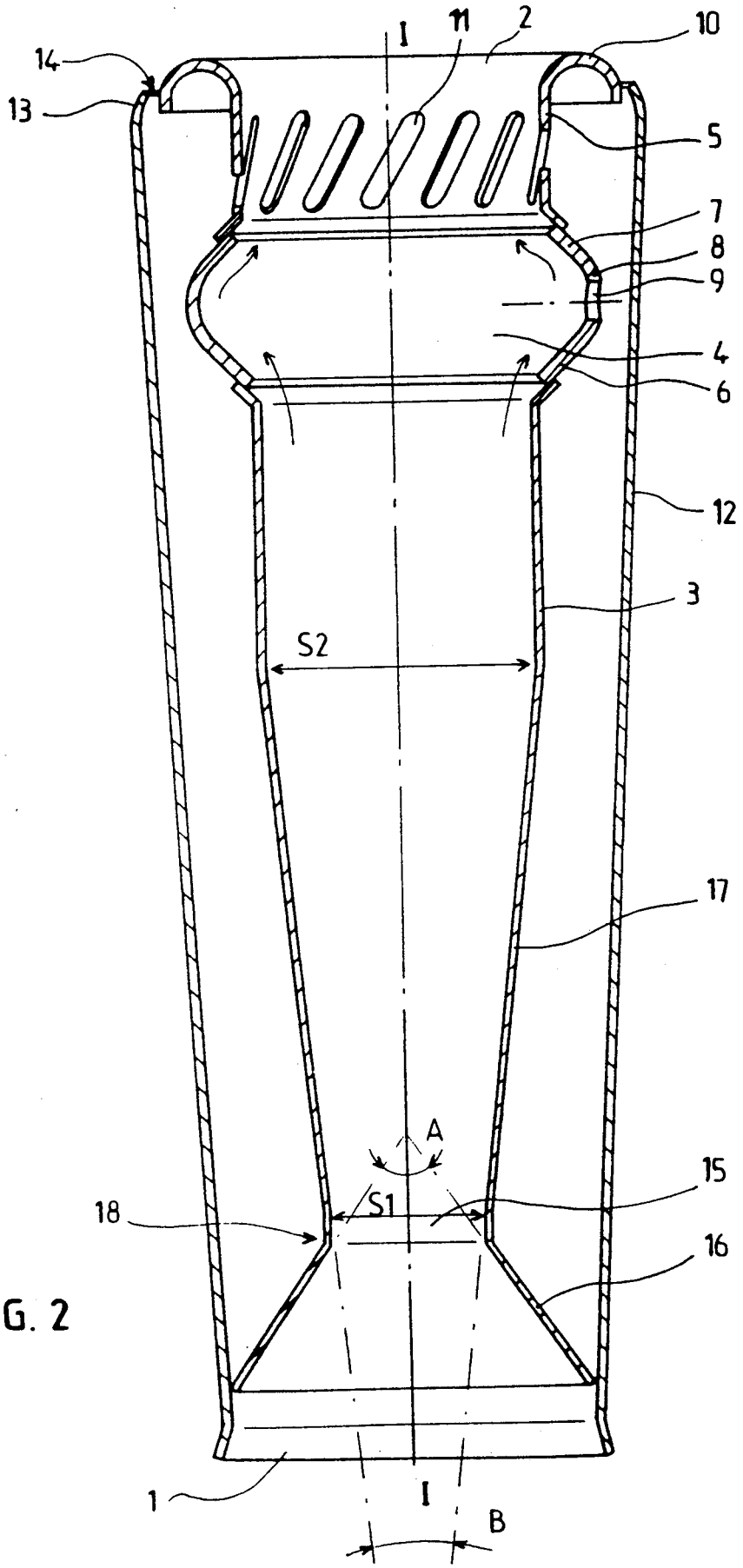
FIG. 2 is a longitudinal section of an exhaust outlet according to a second embodiment of the present invention.

In the embodiment shown in FIG. 2, the upstream portion of the exhaust outlet is identical to that of FIG. 1. On the other hand, in this embodiment, the cylindrical downstream portion 3 is connected to an intermediate expansion chamber 4. An outlet tube 5 conveys the exhaust gases from the intermediate expansion chamber 4 to the outlet orifice 2. The intermediate expansion chamber 4 comprises a first portion 6 with divergent walls in the flow direction of the exhaust gases, adjacent the junction with the cylindrical downstream portion 3 and comprises a second portion 7 with convergent walls in the direction of the exhaust gas flow, adjacent the junction with the outlet tube 5.

The divergent walls of the first portion 6 form substantially a cone whose angle at the apex may advantageously be between about 70° and 100°, for example close to 90°. The same goes for the convergent walls of the second intermediate expansion chamber portion 7.

Good results have been obtained by providing an expansion chamber 4 whose maximum cross section, in the connection zone between the first portion 6 and the second portion 7, is at least 50% greater than the cross section of the cylindrical downstream portion 3.

In the embodiment shown in FIG. 2, the cylindrical downstream portion 3 advantageously has a cross section smaller than that of the outlet tube 5.

The walls of the first intermediate expansion chamber portion 6 are advantageously connected to the walls of the second portion 7 by a central zone 8 of the wall of the intermediate expansion chamber having a rounded profile. In the embodiment shown in FIG. 2, the intermediate expansion chamber central wall zone 8 advantageously comprises at least one discharge orifice 9, in its lower part, for discharge of the dust and liquids brought by the exhaust gases into the cylindrical downstream portion 3 and trapped in the expansion chamber 4.

An outer casing 12 covers also the whole of the lateral faces of the venturi upstream portion 18, of the cylindrical downstream portion 3, of the intermediate expansion chamber 4 and of the outlet tube 5, as shown in the figure.

For the convenience of the drawings, this exhaust outlet has been shown along a longitudinal axis I—I in the vertical direction. Naturally, in the position of use, this exhaust outlet is intended to be used preferably in a horizontal position, i.e. with its longitudinal axis I—I disposed horizontally or with a slight slant with respect to the horizontal.

The lower wall of the outer casing 12 may advantageously be divergent, or inclined downwards, to facilitate discharge of the dust and liquids coming from the intermediate expansion chamber 4 and leaving through the discharge orifice 9.

The outlet tube 5 is cylindrical and ends in the outwardly bent, rounded flange 10, forming the outlet orifice 2. The outlet tube advantageously comprises apertures 11 spaced apart over the periphery of its wall, for example oblong apertures inclined with respect to the longitudinal axis I—I.

During operation, in both of the embodiments of FIGS. 1 and 2, the exhaust outlets according to the present invention, because of the presence of the upstream venturi portion 18, substantially reduce the backlash noise. Comparative tests have been carried out, on a test bench, on the same car equipped with a special exhaust line comprising only direct passage silencers. A first test was carried out by equipping the car with a cylindrical outlet tube without venturi. A second test was carried out by equipping the car with an outlet tube according to the embodiment of FIG. 1. In a third test the car was equipped with an outlet tube according to the embodiment of FIG. 2. In the second and third tests, venturis of different dimensions were tested, with cross section ratios between about 0.35 and 0.70. For each test, measurements were made: sound level when the engine was under stabilized running conditions; backlash sound level at the moment when the accelerator of the engine is suddenly released; maximum power developed by the engine. These measurements were carried out for several rotational speeds of the engine.

The measurements showed that the presence of venturi 18 in the exhaust outlet reduces the static backlash noise by at least one decibel under engine running conditions standardized for type acceptance tests of the noise systems, without substantially affecting the power of the engine, the maximum power remaining constant within 1%.

In the embodiment of FIG. 2, after passing through venturi 18, the exhaust gases flow into the cylindrical downstream portion 3. In the expansion chamber 4, the first expansion chamber portion 6 is under a high depression with respect to the rest of the chamber and captures the particles in suspension in the exhaust gases. These particles are deposited in the low part of the expansion chamber 4 and are discharged by gravity through the lower discharge orifice 9.

Because of the reduction of cross section of the outlet tube 5 with respect to the maximum cross section of the expansion chamber 4, the first portion of outlet tube 5 is under a slight depression and air is sucked from the outside through the apertures 11 and the annular air intake passage 14. The air sucked in penetrating through apertures 11 dilutes the exhaust gases. This air flow improves the flow of the gases and results in a peripheral air layer which protects flange 10 from the deposits of solid or liquid particles still in suspension in the exhaust gases. This air flow further improves the aeraulic behavior of the exhaust outlet and prevents the power of the internal combustion engine from being disturbed despite the presence of the expansion chamber 4.

The outer casing 12 protects the axial tubular duct. Its function is also to create a volume about the central portions of the exhaust outlet, which volume gives a deeper characteristic sound to the exhaust, by eliminating certain high frequency components.

In the embodiments which have been shown, the different tubular parts of the exhaust outlet may be cylindrical or conical of revolution, i.e. have a circular cross section.

Alternately, the different tubular portions may have an oval, polygonal or other cross section.

The present invention is not limited to the embodiments which have been more explicitly described, but includes the different variations and generalizations thereof contained within the scope of the following claims.

What is claimed is:

1. Exhaust outlet intended to form the end zone of an internal combustion engine exhaust line, comprising an inlet orifice for the inlet of exhaust gases with means for connection to an exhaust gas conduction duct, and an outlet orifice open to the free air for the discharge of the gases, an axial tubular duct conveying the gases from the inlet orifice to the outlet orifice, wherein the axial tubular duct comprises:

an axial upstream duct portion in the form of a venturi, defined by an upstream convergent continuous venturi wall with open angle A connected, in a narrowed portion, to a downstream divergent continuous venturi wall with more reduced angle B, a cylindrical downstream axial duct portion connected continuously to the downstream venturi wall, the ratio between the cross sectional area S1 of the narrowed portion and the cross sectional area S2 of the cylindrical downstream portion being between about 0.35 and 0.70, the upstream wall being connected continuously to the inlet orifice, wherein the upstream wall comprises means for preventing air from entering the exhaust line.

2. Exhaust outlet as claimed in claim 1, wherein the open angle a of the upstream wall is between about 60° and 90°.

3. Exhaust outlet as claimed in claim 1, wherein the angle B of the downstream wall is between about 7° and 30°.

4. Exhaust outlet as claimed in claim 1, wherein the cross sectional area of the inlet orifice is greater than the cross sectional area S2 of the cylindrical downstream portion.

5. Exhaust outlet as claimed in claim 1, wherein the cylindrical downstream portion is connected to an intermediate expansion chamber itself connected to an outlet tube conveying the gases to the outlet orifice.

6. Exhaust outlet as claimed in claim 5, wherein the outlet tube has a larger cross sectional area than the cross sectional area S2 of the cylindrical downstream portion.

7. Exhaust outlet as claimed in claim 5, wherein the central zone of the wall of the intermediate expansion chamber comprises at least one dust and liquid discharge orifice in its lower part.

8. Exhaust outlet as claimed in claim 7, wherein the outlet tube comprises apertures spaced apart over the periphery of its wall, associated with an air intake for the intake of outside air through the apertures towards the inside of the outlet tube.

9. Exhaust outlet as claimed in claim 1, wherein the exhaust outlet comprises an outer casing covering continuously the lateral faces of the axial tubular duct from the inlet orifice as far as the outlet orifice, the exhaust outlet including a flange which, with the outer casing, defines an annular passage, and wherein in the zone of the outlet orifice the flange is separated from the outer casing.

10. Exhaust outlet as claimed in claim 9, wherein the outer casing is conical, opening out in the direction of the outlet orifice.

11. Exhaust outlet intended to form the end zone of an internal combustion engine exhaust line, comprising an inlet orifice with means for connection to an exhaust gas conduction duct, and an outlet orifice open to the free air for the discharge of the gases, an axial tubular duct conveying the gases from the inlet orifice to the outlet orifice, wherein the axial tubular duct comprises:

an axial upstream duct portion in the form of a venturi, defined by an upstream convergent continuous venturi wall with open angle A connected, in a narrowed portion, to a downstream divergent continuous venturi wall with more reduced angle B, a cylindrical downstream axial duct portion connected continuously to the downstream venturi wall, the ratio between the cross sectional area S1 of the narrowed portion and the cross sectional area S2 of the cylindrical downstream portion being between about 0.35 and 0.70, the upstream wall being connected continuously to the inlet orifice, and wherein the cross sectional area of the inlet orifice is greater than the cross sectional area S2 of the cylindrical downstream portion.

12. Exhaust outlet intended to form the end zone of an internal combustion engine exhaust line, comprising an inlet orifice with means for connection to an exhaust gas conduction duct, and an outlet orifice open to the free air for the discharge of the gases, an axial tubular duct conveying the gases from the inlet orifice to the outlet orifice, wherein the axial tubular duct comprises:

an axial upstream duct portion in the form of a venturi, defined by an upstream convergent continuous venturi wall with open angle A connected, in a narrowed portion, to a downstream divergent continuous venturi wall with more reduced angle B, a cylindrical downstream axial duct portion connected continuously to the downstream venturi wall, the ratio between the cross sectional area S1 of the narrowed potion and the cross sectional area S2 of the cylindrical downstream portion being between about 0.35 and 0.70, the upstream wall being connected continuously to the inlet orifice, wherein the cylindrical downstream portion is connected to an intermediate expansion chamber itself connected to an outlet tube conveying the gases to the outlet orifice, wherein the outlet tube has a larger cross sectional area than the cross sectional area S2 of the cylindrical downstream portion.

13. Exhaust outlet intended to form the end zone of an internal combustion engine exhaust line, comprising an inlet orifice with mans for connection to an exhaust gas conduction duct, and an outlet orifice open to the free air for the discharge of the gases, an axial tubular duct conveying the gases from the inlet orifice to the outlet orifice, wherein the axial tubular duct comprises:

an axial upstream duct portion in the form of a venturi, defined by an upstream convergent continuous venturi wall with open angle A connected, in a narrowed portion, to a downstream divergent continuous venturi wall with more reduced angle B, a cylindrical downstream axial duct portion connected continuously to the downstream venturi wall, the ratio between the cross sectional area S1 of the narrowed portion and the cross sectional area S2 of the cylindrical downstream portion being between about 0.35 and 0.70, the upstream wall being connected continuously to the inlet orifice, wherein the cylindrical downstream portion is connected to an intermediate expansion chamber itself connected to an outlet tube conveying the gases to the outlet orifice, wherein the central zone of the wall of the intermediate expansion chamber comprises at least one dust and liquid discharge orifice in its lower part.

14. The exhaust outlet of claim 13, wherein the outlet tube comprises apertures spaced apart over the periphery of its wall, associated with an air intake for the intake of outside air through the apertures towards the inside of the outlet tube.

15. Exhaust outlet intended to form the end zone of an internal combustion engine exhaust line, comprising an inlet orifice with means for connection to an exhaust gas conduction duct, and an outlet orifice open to the free air for the discharge of the gases, an axial tubular duct conveying the gases from the inlet orifice to the outlet orifice, wherein the axial tubular duct comprises:

an axial upstream duct portion in the form of a venturi, defined by an upstream convergent continuous venturi wall with open angle A connected, in a narrowed portion, to a downstream divergent continuous venturi wall with more reduced angle B, a cylindrical downstream axial duct portion connected continuously to the downstream venturi wall, the ratio between the cross sectional area S1 of the narrowed portion and the cross sectional area S2 of the cylindrical downstream portion being between about 0.35 and 0.70, the upstream wall being connected continuously to the inlet orifice, wherein the exhaust outlet comprises an outer casing covering continuously the lateral faces of the axial tubular duct from the inlet orifice as far as the outlet orifice, the exhaust outlet including a flange which, with the outer casing, defines an annular passage, and wherein in the zone of the outlet orifice the flange is separated from the outer casing.

16. The exhaust outlet of claim 15, wherein the outer casing is conical, opening out in the direction of the outlet orifice.

* * * * *